United States Patent [19]

Chey

[11] Patent Number: 4,626,850

[45] Date of Patent: Dec. 2, 1986

[54] VEHICLE DETECTION AND COLLISION AVOIDANCE APPARATUS

[75] Inventor: Young H. Chey, Irvine, Calif.

[73] Assignee: David Chey, Irvine, Calif. ; a part interest

[21] Appl. No.: 494,948

[22] Filed: May 16, 1983

[51] Int. Cl.[4] ..... G08G 1/16; G08G 1/00

[52] U.S. Cl. ..... 340/903; 340/904

[58] Field of Search ..... 340/904, 943, 933, 901, 340/935, 903; 318/15; 296/37.7, 37.8, 76, 223; 455/99, 345, 346; 367/118, 909, 111; 180/169, 7 BM; 343/7 VM, 5 BB, 711, 713, 717, 455

[56] References Cited

U.S. PATENT DOCUMENTS

| | | | |
|---|---|---|---|
| 2,935,565 | 5/1960 | MacAdam et al. . | |
| 3,553,638 | 6/1969 | Sublett . | |
| 3,681,750 | 8/1972 | Larka | 340/904 |
| 3,842,397 | 10/1974 | Sindle . | |
| 4,028,662 | 6/1977 | Young | 340/904 |
| 4,103,278 | 7/1978 | Satake et al. . | |
| 4,240,152 | 12/1980 | Duncan et al. . | |
| 4,247,924 | 1/1981 | Baird | 367/111 |
| 4,278,962 | 7/1981 | Lin | 340/904 |
| 4,450,430 | 5/1984 | Barishpolsky et al. | 340/904 |
| 4,467,313 | 8/1984 | Yoshino et al. | 367/909 |
| 4,500,977 | 2/1985 | Gelhard | 367/909 |

*Primary Examiner*—John W. Caldwell, Sr.
*Assistant Examiner*—Tyrone Queen

[57] ABSTRACT

A dual operational mode vehicle detection and collision avoidance apparatus is disclosed characterized by use of a single active or passive acoustic ranging device mounted for azimuth directional movement relative the vehicle to automatically detect the presence and direction of objects in the vicinity of the vehicle. Signals generated by the ranging device are time processed along with azimuth directional signals to generate an output utilized to provide both an audio and visual display of distance and direction of the detected object from the vehicle. In a first operational mode, i.e. a surveillance mode, the acoustic ranging device is sequentially positioned in a left, center and right azimuth directional position to selectively indicate the presence of objects in the individual azimuth direction. In a second operational mode, i.e. a lane change mode, the acoustic ranging device is driven to either a left or right azimuth directional position in response to actuation of the vehicle's turn indicator lever to continuously detect the presence of objects in the adjacent lane of a roadway.

2 Claims, 8 Drawing Figures

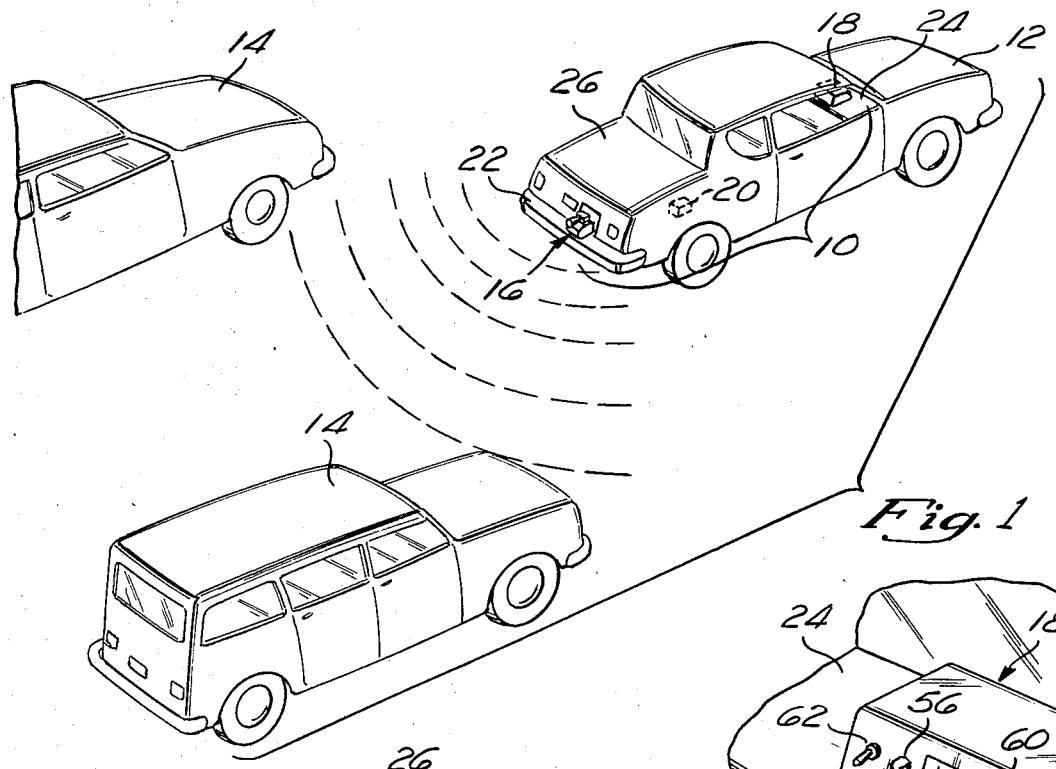
Fig. 1
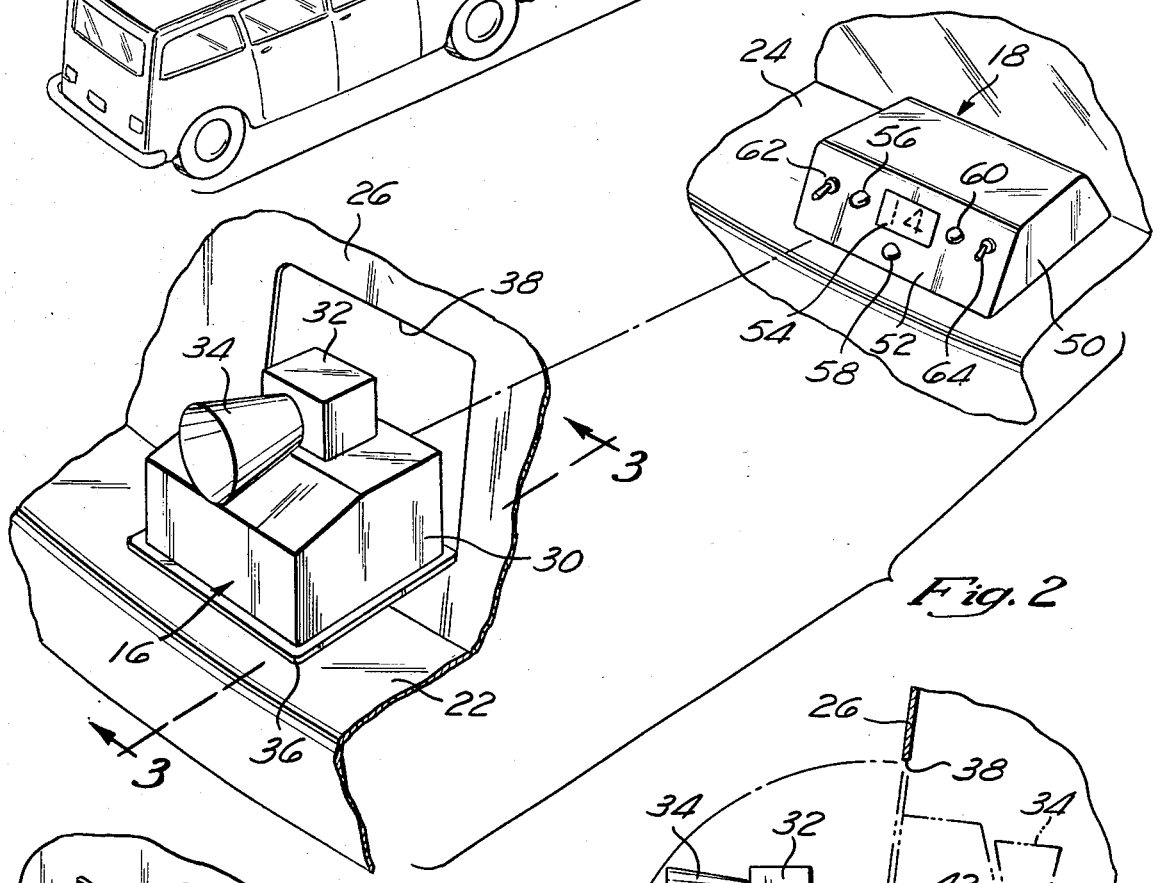
Fig. 2
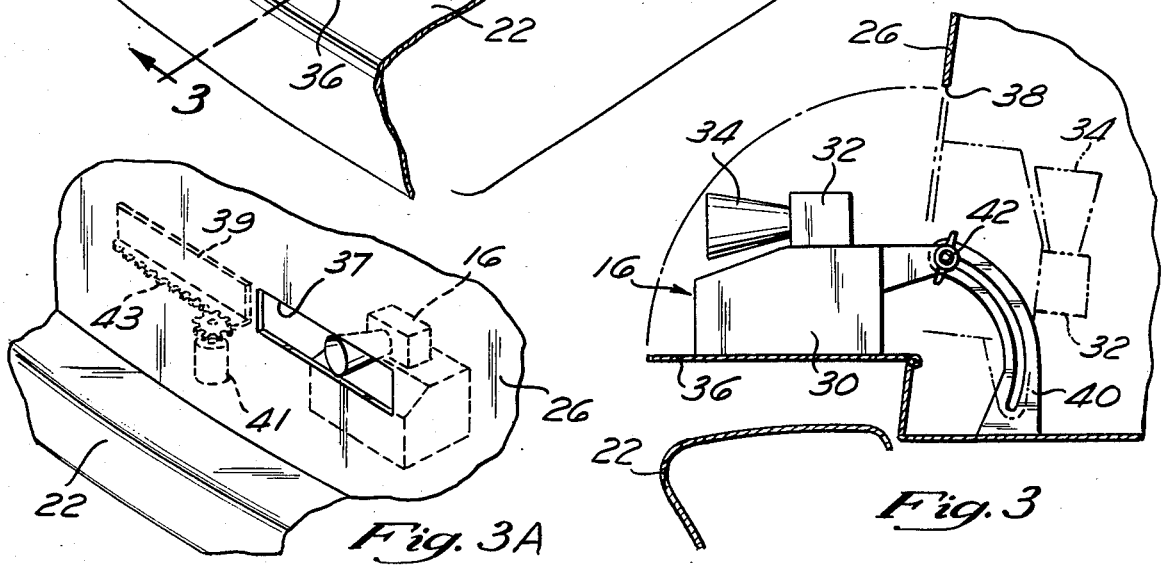
Fig. 3A
Fig. 3

Fig. 4
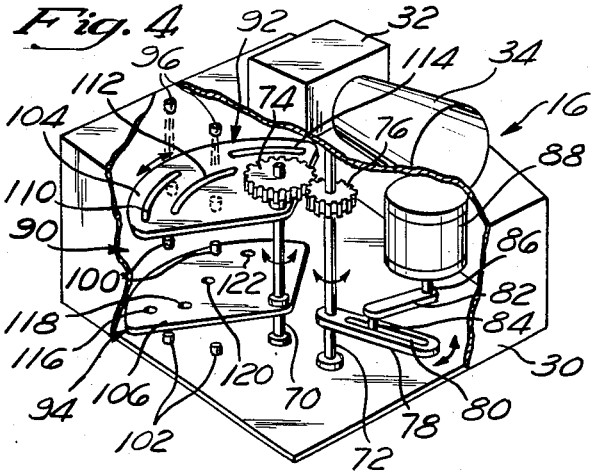
Fig. 5
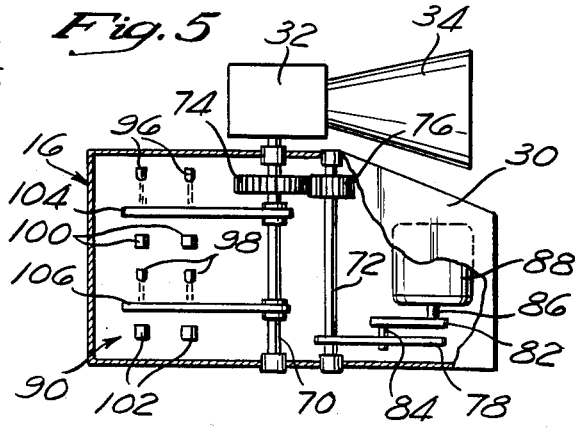
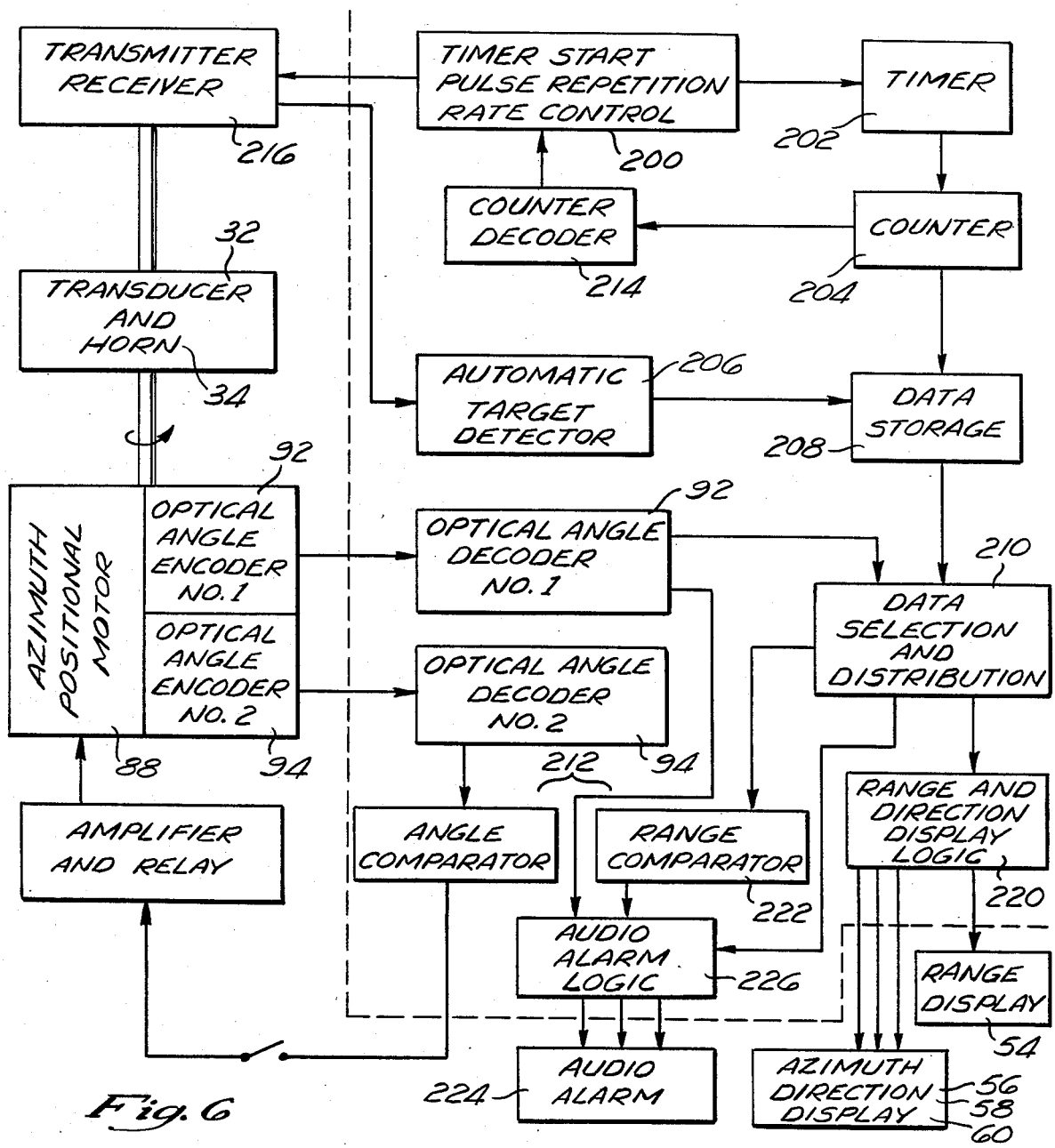
Fig. 6

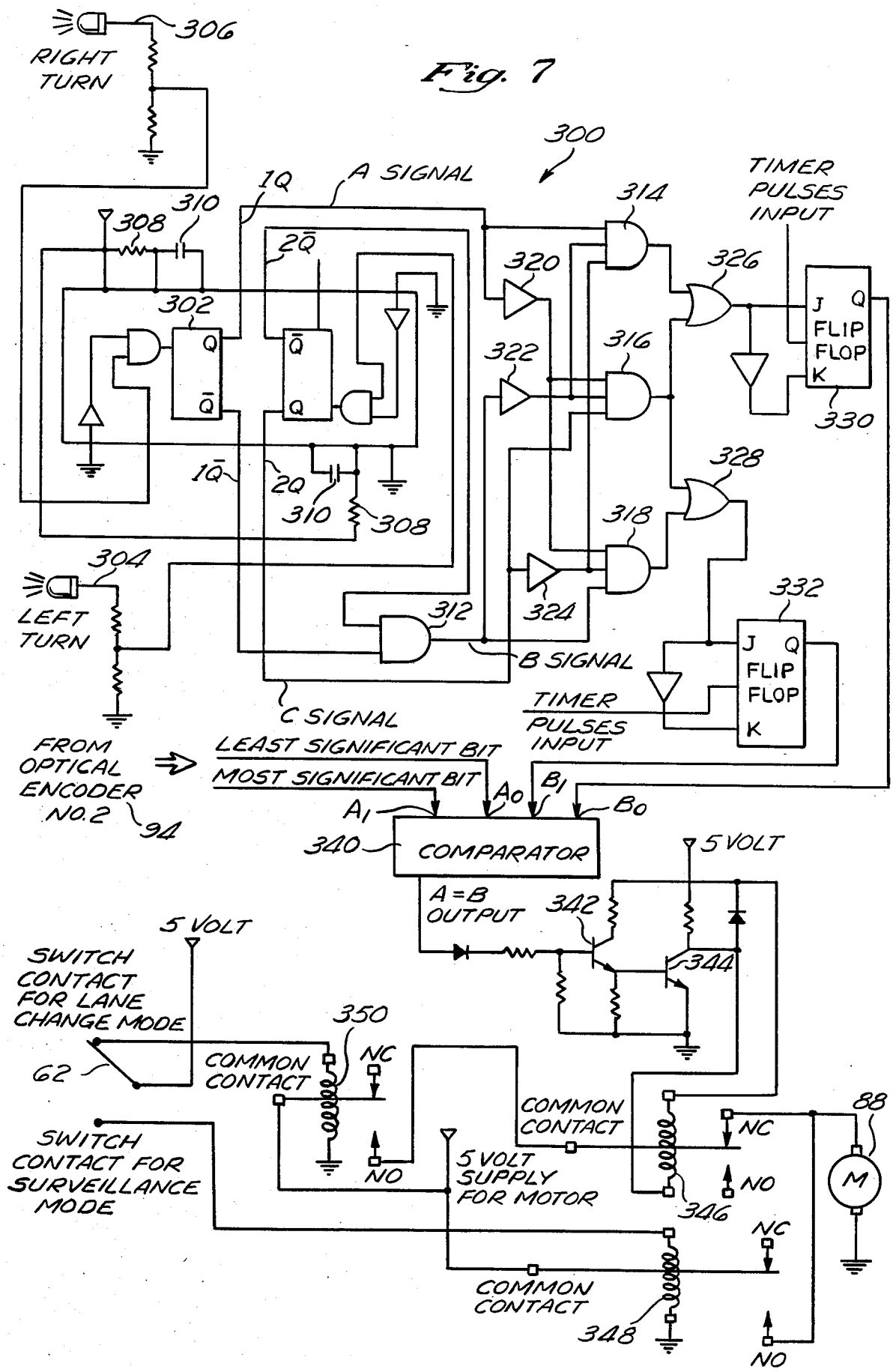
Fig. 7
RIGHT TURN
306
300
A SIGNAL
1Q
310
308
2Q̄
302
Q
Q̄
Q̄
Q
1Q̄
2Q
310
308
314
320
326
TIMER PULSES INPUT
J Q
FLIP FLOP
K
330
322
316
328
318
304
LEFT TURN
312
324
332
B SIGNAL
J Q
FLIP FLOP
K
C SIGNAL
TIMER PULSES INPUT
FROM OPTICAL ENCODER NO.2
94
LEAST SIGNIFICANT BIT
MOST SIGNIFICANT BIT
A0
B1
A1
B0
340
COMPARATOR
5 VOLT
A=B OUTPUT
342
344
5 VOLT
SWITCH CONTACT FOR LANE CHANGE MODE
62
350
COMMON CONTACT
NC
NO
COMMON CONTACT
NC
NO
346
88
M
SWITCH CONTACT FOR SURVEILLANCE MODE
5 VOLT SUPPLY FOR MOTOR
NC
COMMON CONTACT
348
NO

VEHICLE DETECTION AND COLLISION AVOIDANCE APPARATUS

BACKGROUND OF THE PRESENT INVENTION

The present invention relates broadly to ranging and detection systems and more particularly to a dual mode, vehicle detection and collision avoidance apparatus characterized by use of a single active or passive acoustic ranging device mounted for azimuth directional movement relative the vehicle to automatically detect the presence and direction of objects in the vicinity of the vehicle.

As is well known, it is oftentimes necessary for a driver of a vehicle to observe the immediate area in the vicinity of his vehicle to effectuate a particular driving manuever. For instance, when a driver of a vehicle is traveling on a roadway, it is routinely necessary for the driver to change lanes to avoid vehicles traveling at differing speeds or to enter or exit the highway. Heretofore, it has been customary practice by drivers to attempt to view the area in the vicinity of the vehicle by way of one or more mirrors mounted on the interior or exterior of the vehicle or, alternatively for drivers to turn their heads to visually observe a particular area. As will be recognized, the various interior and exterior mounted mirrors of the vehicle typically yield a selective area (blindspot) in the vicinity of the vehicle which cannot be properly observed, thereby rendering a driving manuever dangerous while the turning of the driver's head to visually observe the desired area requires the driver to be momentarily inattentive to the vicinity in front of the vehicle. Thus, these two alternatives for observing the selected areas in the vicinity of the vehicle prior to making a driving maneuver have proven less than ideal and usually have posed a significant safety hazard to the driver of the vehicle or adjacent vehicles on the roadway.

Although the above-referenced problems have been recognized to a limited extend in the prior art, the solutions to date have typically comprised vehicle warning systems utilizing multiple ultrasonic transmitters and receivers mounted on the vehicle such as that disclosed in U.S. Pat. No. 4,240,152—Duncan and U.S. Pat. No. 3,842,397—Syndle. The use of such multiple transmitter receiver transducers necessarily increases the cost of the vehicle warning system making the same economically unfeasible for the majority of the purchasing public. In addition, the majority of such prior art vehicle warning devices have either failed to provide suitable visual and/or audible signals to the driver of the vehicle to indicate the distance and direction of the detected object from the vehicle or have been incapable of detecting the presence of objects on the side of the driver's vehicle.

Thus, there exists a substantial need in the art for a relatively economical vehicle detection and collision avoidance apparatus which may be utilized to detect the presence and direction of objects located both on the left, center and right sides of the vehicle and provide both a visual as well as audible alarm to make the driver of the vehicle aware of the presence of such detected objects.

SUMMARY OF THE PRESENT INVENTION

The present invention specifically addresses and alleviates the above-referenced deficiencies associated in the art by providing a dual mode vehicle detection and collision avoidance apparatus. More particularly, the present invention discloses a dual mode vehicle detection and collision avoidance apparatus characterized by use of a single active or passive acoustic ranging device mounted for azimuth directional movement relative the vehicle to automatically detect the presence and direction of objects in the vicinity of the vehicle. Electrical signals generated by the ranging device are time processed along with azimuth direction signals to generate an output utilized to provide both an audio and visual display of the distance and direction of one or multiple detected objects from the vehicle.

In the preferred embodiment, a portable and highly compact transmitter/receiver transducer unit is mounted for azimuth directional movement adjacent the rear bumper or rear portion of the vehicle. The transducer emits acoustic energy through a conical horn and receives acoustic echo energy through the same horn. The use of the particular conical-shaped horn has been found to intensify the accuracy and capability of the ranging device thereby permitting even relatively small objects in the vicinity of the vehicle to be detected.

The apparatus of the present invention additionally incorporates a display unit which may be advantageously positioned upon the dashboard of the vehicle. In addition, a computer control unit may be positioned in the vehicle, i.e. either in the interior compartment or preferably the trunk of the vehicle, which processes signals received from the transmitter/receiver transducer and sends the processed signals to the display unit. In the preferred embodiment, the display unit includes a two-digit numeric display as well as three separate light emitting diode visual displays. The light emitting diodes illuminate one at a time indicating the instantaneous azimuth angle direction of the transducer transmitter/receiver.

In a first operational mode, i.e. a surveillance mode, the transmitter/receiver/transducer is sequentially positioned in a left, center and right azimuth direction by way of a small electric motor. Signals received from the transducer at each of the azimuth directional positions are processed and subsequently displayed upon the display panel. In the preferred embodiment, the light emitting diodes located on the display panel illuminate one at a time indicating the instantaneous azimuth angle position of the transducer receiver. More particularly, each of the light emitting diodes illuminates a first color, i.e. green, when the transducer horn is directed in the particular azimuth angle and there are no objects detected in that direction. However, the light emitting diode will change to a second color, i.e. red, when the object appears in the particular azimuth direction. Preferably, when the detected object is located within a predetermined minimum distance, i.e. ten feet, from the transmitter/receiver transducer, the red illuminated light emitting diode will subsequently flash to indicate a visual warning to the driver of the rear presence of the object. Simultaneously, the two-digit numeric display located on the display panel indicates the particular distance (preferably in feet) of the detected object from the vehicle in each of the separate azimuth directional positions. To augment the visual warning capabilities of the present invention, the apparatus additionally provides an audible warning when the detected object in the particular azimuth directional indicator is within the predetermined minimum distance of the vehicle, the frequency of which is typically modulated such that differing frequency sounds are provided for each of the three separate azimuth directional positions.

In a second operational mode, i.e. a lane change mode, the azimuth directional position of the transducer receiver is controlled by the turn signal switch of the vehicle such that by manually turning the turn signal of the vehicle to indicate a right turn, the transmitter/-receiver transducer is directed into a right size azimuth position; turning the turn switch to indicate a left turn will position the in a left azimuth position and leaving the turn signal switch in a neutral non-turn position, causes the to remain in a center azimuth directional position. With the apparatus functioning in this lane change operational mode, the driver of the vehicle thereby obtains both a visual and audible warning of the presence or nonpresence of an object and thereby enables the driver to effectuate a proper driving maneuver, i.e. lane change.

In the preferred embodiment, the transmitter/-receiver transducer and associated azimuth directional device can be installed adjacent the rear bumper of a vehicle. However, provisions are also possible for installing the same within the interior of the vehicle to prohibit theft and improve the aesthetics of the vehicle. Although in the preferred embodiment the invention is utilized on vehicles such as trucks, buses, and automobiles, the apparatus is additionally applicable to other nonvehicle installation such as for home security systems or campground or campsite monitoring applications. The present invention additionally operates on extremely low power requirements, i.e. 7 watts, thereby not placing an overburden upon conventional electrical battery systems of the vehicle.

The present invention also helps the driver to avoid collisions while backing out of a parking space. Often the parking space is occupied by vehicles to the right and left and the driver's view is blocked. The sequentially directing transducer will thus detect any passing vehicles behind and the sound of audible alarm system will warn the driver of an imminent collision.

DESCRIPTION OF THE DRAWINGS

These as well as other features of the present invention will become more apparent upon reference to the drawings, wherein:

FIG. 1 is a perspective view of the vehicle detection and collision avoidance apparatus of the present invention mounted adjacent the rear bumper of a vehicle, depicted in operation detecting the presence of other vehicles on the roadway;

FIG. 2 is a perspective view depicting the display panel mounted within the interior of the vehicle and the transducer/transmitter/receiver unit mounted adjacent the rear bumper of the vehicle;

FIG. 3 is an elevational view illustrating one mounting means for permitting the transducer/transmitter/-receiver unit to be selectively stowed within the interior of the trunk compartment of the vehicle and subsequently deployed in an operational mode;

FIG. 3A is a partial perspective view of a second mounting means for permitting the transmitter/receiver transducer unit to be continuously positioned within the interior of the trunk compartment of the vehicle during use and storage;

FIG. 4 is a perspective view of the azimuth directional movement mechanism which serves to position the transmitter/receiver transducer in a desired azimuth direction;

FIG. 5 is a partial cross-sectional view of the azimuth directional movement mechanism of FIG. 4;

FIG. 6 is an electrical schematic flow diagram of the computer control unit of the present invention;

FIG. 7 is an electrical schematic of the lane change operational mode control circuit of the present invention.

DETAILED DESCRIPTION OF THE PREFERRED EMBODIMENT

Referring to FIG. 1, there is shown the vehicle detection and collision avoidance apparatus of the present invention designated generally by the numeral 10 disposed upon a vehicle such as a automobile 12 and adapted to detect the presence, direction and range of other objects 14 in the vicinity of the vehicle 12. The apparatus 10 is composed generally of an acoustic ranging device 16, display unit 18, and computer control unit 20 which are preferably positioned adjacent the rear bumper 22, dashboard 24, and trunk compartment 26, respectively, of the vehicle 12.

Referring more particularly to FIGS. 2 and 3, the acoustic ranging system 16 includes a housing 30 which mounts an acoustic transducer 32 thereon. Although in the preferred embodiment the acoustic transducer 32 comprises a compact transmitter/receiver transducer which emits acoustic energy through a conical horn 34 and receives acoustic echo energy through the same horn 34, those skilled in the art will recognize that passive acoustic receiving devices can additionally be used without departing from the spirit of the present invention. As is well known, such ultra-sonic transducers 32 include a radiating circular plate surface the reverse side of which is adhered two-semi circular piezoelectric ceramic plates. A transmitter receiver electronic package which contains a transmit wave form generator and several stages of receiver amplifiers is additionally provided. The acoustic horn 34 which provides a beam width of approximately 15 degrees additionally serves to provide a good impedance match between the transducer 32 and air. The housing 30 may be positioned adjacent the rear bumper 22 of the vehicle 12 in a variety of manners such as direct mounting to the bumper 22 or as depicted in FIGS. 3 and 3*a*. In the embodiment of FIG. 3, the housing 30 is rigidly attached to a plate 36 pivotally attached to a portion of the trunk 26 of the vehicle 12. The plate 36 is sized to cover a mating aperture 38 formed in the trunk 26 of the vehicle 12. A mounting linkage 40 is additionally mounted within the interior of the trunk 26 of the vehicle 12 and connected via a wing nut arrangement 42 to the housing 30. By such an arrangement, it will be recognized that the acoustic ranging device 16 may be stowed inside the trunk compartment 26 of the vehicle 12 when not in use (as indicated by the phantom line in FIG. 3) and pivotally lowered into an operative position as indicated by the full line position in FIG. 3 when desired to be deployed. Thus, possible theft or vandalism to the acoustic ranging device 16 is substantially reduced.

In FIG. 3*a*, a second mounting embodiment is depicted which contemplates the forming of an elongate aperture on slot 37 in the trunk compartment 26. A cover plate 39 is mounted for reciprocal movement within the trunk compartment 26 via a servo motor 41 and gear rack 43 arrangement to cause the plate 39 to selectively block and unblock the aperture 37. The acoustic ranging device 16 is positioned within the trunk compartment 26 having its horn 34 and transducer 32 aligned with the aperture 37. As such, both in an operative and inoperative mode, the acoustic ranging device is shielded from environmental elements within the trunk compartment.

The display device 18 is formed having a generally rectangular-shaped housing 50 which may be mounted by conventional means to the dashboard 24 of the vehicle 12 and oriented such that the front face 52 of the housing 50 is readily viewable by the driver (not shown) of the vehicle 12. The front face 52 of the housing 50 is preferably provided with a multiple digit numeric display 54 positioned adjacent the central portion of the face 52 as well as three lamp indicators 56, 58 and 60 disposed on the left, center and right side respectively of the numeric display 54. In the preferred embodiment, each of the lamp indicators 56, 58 and 60 are provided with plural light emitting diodes (LED) which initially illuminate in a first color such as green to indicate the nonpresence of a detected object and subsequently change to a second color (for instance red) when an object is detected by the apparatus 10. Preferably, the second color or "red" LED diode is additionally adapted to flash on and off when the detected object is within a certain predetermined minimum distance from the vehicle 12 to warn the driver of imminent danger. A pair of single pole double throw switches 62 and 64 are additionally provided on the front surface 52 of the display panel 18 with the switch 62 being adapted to provide selection between the lane change and surveillance operational modes of the apparatus 10 while the switch 64 permits the activation or deactivation of an audible alarm utilized upon detection of an object.

Referring more particularly to FIGS. 4 and 5, the acoustic transducer 32 and its associated horn 34 are mounted for pivotal or, i.e. azimuth, directional movement relative the housing 30 with the transducer 32 being mounted to a axle 70 which is journaled adjacent opposite ends to the housing 30. An additional axle 72 is journaled adjacent its opposite ends to the housing 30 and is disposed in a parallel orientation with the axle 70. A pair of mating gears 74 and 76 are disposed on the axle 70 and 72, respectively, and are preferably dissimilarly sized to provide a gear-reduction ratio. A strut 78 rigidly attached adjacent the opposite end of the axle 72 includes an elongated slot or aperture 80 formed therein. A crank arm 82 cooperates with the strut 78 via a pin 84 disposed within the elongated slot 80. The crank arm 82 is attached to the output shaft 86 of an electric motor 88 disposed within the housing 30. By such an arrangement, it will be recognized that as the crank arm 82 is driven by the electric motor 88 in a unidirectional rotational movement, the cooperation of the pin 84 within the elongated slot 80 causes the strut 78 to rotate or pivot back and forth through an arc as indicated by the arrows in FIG. 4. Correspondingly, the axle 72 rotates back and forth through an arcuate length which is transmitted via the mating gears 76 and 78 to the axle 70. As such, the transducer 32 and its associated horn 34 are provided back and forth in an arcuate plane or azimuth scan, the arcuate travel of which may be adjusted by proper selection of a gear ratio between the gears 74, 76 as well as the positioning of the pin 84 along the length of the crank arm 82.

To provide an electrical signal indicative of the instantaneous azimuth direction of the transducer 32 and horn 34, an optical angle encoder device designated generally by the numeral 90 is provided within the housing 30. The optical angle encoder 90 basically includes a pair of optical angle encoders 92 and 94 each of which includes a pair of light sources 96 and 98 which in the preferred embodiment comprise an infrared wave emitting diode. Each of the pair of light sources 96 and 98 are coaxially aligned with a corresponding pair of photo-transistors 100 and 102, respectively. A fan-shaped plate member 104 and 106 is disposed between the light source and matching photo-transistors pairs 96 and 98 and 100 and 102 both of which are rigidly attached to the axle 70.

As best shown in FIG. 4, the plate 104 is provided with three elongate arcuate apertures 110, 112, and 114 which are positioned to selectively pass and block the transmission of light from the light source pairs 96 to their matching photo-transistors 100 during rotation of the axle 70 such that an electrical or logic signal is provided when the transducer 32 and its associated horn 34 are positioned in its left, center and right azimuth direction. As will be explained in more detail infra, the logic signals generated by the first angle encoder 92 are utilized for an output to the light sources 56, 58, and 60 positioned on the display 18 to indicate the instantaneous left, center and right azimuth direction of the transducer 32.

The second fan-like plate 106 is provided with a plurality of circular apertures 116, 118, 120, and 122 which are positioned so as to be selectively coaxially aligned with the light source pairs 98 and photo-transistor pairs 102 during rotation of the axle so as to selectively block and unblock the passage of light from the light source pairs 98 to their matching photo-transistors 102. As will be recognized, the apertures 116 through 122 are positioned upon the plate 106 such that a high level logic signal is additionally provided when the transducer 32 and horn 34 are positioned in its left, center and right azimuth directional position. As will become more apparent infra, the logic signals generated by the second angle encoder 94 are utilized in the lane change operational mode of the present invention.

Referring to FIG. 6, the flow diagram of the computer-control unit 20 is illustrated. Basically, the components of the computer-control unit 20 are well-known in the art and comprise a timer, start pulse repetition rate control 200, a timer 202, a counter 204, an automatic target detector 206, a data storage device 208, the first and second optical angle decoder 92 and 94, respectively, a data selection and distribution system 210, and a angle and range comparator system designated generally by the numeral 212.

In operation, the timer start pulse repetition rate control 200 generates a cycle starting electrical pulse or signal which is sent to the timer 202. The timer output which comprises a train of electrical pulses is subsequently sent to the counter 204. The pulse width of the electrical pulses is preferably selected to equal the time needed for the acoustic signal to travel one foot distance. The pulse is followed by a dead time equal to the pulse width. A counter decoder 214 is provided with a flip flop (not shown) and is programmed to regulate the timer 202 stop time.

The automatic target detector 206 is connected to the transducer 32 via a transmitter receiver 216 and thereby is responsive to the detection of the presence of an object by the transducer 32. Upon the automatic target detector 206 detecting the presence of an object, the output signal of the counter 204 is transferred to the data storage device 208. As is conventional in the art, the data storage device 208 preferably consists of a pair of shift registers. The data selection and distribution device 210 selects data from the data storage device 208 and the optical angle decoder 92 and distributes the same to a range and direction display logic device 220 and range comparator 222. The range direction display logic device 220 subsequently drives the two-digit range display 54 and the three indicator lights 56, 58 and 60 of the azimuth direction display to provide a visual indication of the range and azimuth direction of the detected object to the driver. Simultaneously, the distributed data to the range comparator 220 is compared with the fixed chosen number whereby whenever the range is less than the fixed number, a high level logic signal appears on the output of the comparator 222. This high level logic output is coupled with the output of the optical angle decoder number 1 (92) to activate the audio alarm 224 through the audio alarm logic device 226.

In FIG. 7, a schematic diagram of the lane change mode control circuit is shown it being understood that this particular control circuitry becomes operative by the manual activation of the single pole double-throw switch 62 on the display device 18 from a surveillance operational mode to a lane change operational mode. In this particular lane change operational mode, the azimuth directional position of the transducer 32 and its associated horn 34 is controlled by the operation of the turn signal lever of the vehicle 12 such that when a left turn signal lever is manually activated by the driver, the transducer 32 is positioned to its left azimuth directional position; when a right turn signal lever is activated by the driver, the transducer 32 is rotated to its right azimuth directional position and when the turn signal lever is maintained in a neutral position, the transducer 32 is positioned in its center azimuth directional position.

The lane change circuitry designated generally by the numeral 300 in FIG. 7 includes an integrated circuit chip 302 which comprises a pair of retriggerable monostable multivibrators. The input of the multivibrators 302 is connected to the electrical signals generated from the left and right turn signals lamps 304 and 306, respectively, of the vehicle 12 after the voltage of the turn signal lamps 304 and 306 are reduced to a suitable level. An external resistor 308 and capacitor 310 is provided to permit adjustment of the time constant of the multivibrator.

As is known, the input wave form of the turn signal lamps 304 and 306 comprises a train of pulses while the output signal Q of the multi-vibrator is an elongated single pulse which length is approximately equal to the total time duration of the input pulses. The two outputs of the multi-vibrator designated as $1\overline{Q}$ and $2\overline{Q}$ are connected to a two input AND gate 313, the output of which generates a high level logic signal B, indicative of the neutral position of the turn signal lever of the vehicle 12, i.e. when neither the left turn signal lights 304 or right turn signal light 306 are operative. Similarly, activation of the right turn signal lamp 306 generates an "A" logic signal while the left turn signal generates a "C" logic signal. The logic signals "A, B, and C" are connected in the manner shown in FIG. 7 to three separate three-input AND gates 314, 316, and 318 through three signal inverters 320, 322, and 324, respectively. In addition, the output of the AND gates 314, 316 and 318 are connected to 2 two-input OR gates 326 and 328 which drive a respective flip flop 330 and 332, respectively. The output of the flip flops 330 and 332 are connected to input terminal B0 and B1 of a comparator 340 with the two bit data of the optical angle encoder 94 similarly being connected to the A0 and A1 inputs of the comparator 340.

From the above, it will be recognized that a mathematical relationship exists between the turn signal indicator position, logic levels A, B and C signal, and the outputs of the flip flops 330 and 332 which is summarized below:

| TURN INDICATOR | LOGIC LEVELS* | | | FLIP FLOP OUTPUT | |
|---|---|---|---|---|---|
| STATUS | A | B | C | 330 | 332 |
| Right Activated | 1 | 0 | 0 | 1 | 0 |
| Neutral | 0 | 1 | 0 | 0 | 1 |
| Left Activated | 0 | 0 | 1 | 1 | 1 |

*High level logic is designated by Numeral 1 and low level by Numeral 0.

The following Boolean Algebraic Equations (i.e. logic equations) are thereby derived:

$$\text{OUTPUT OF FLIP FLOP 330} = A\overline{B}\overline{C} + \overline{A}\overline{B}C$$

$$\text{OUTPUT OF FLIP FLOP 333} = \overline{A}B\overline{C} + \overline{A}\overline{B}C$$

As will be recognized, the implementation of this Boolean equation is accomplished by the control circuitry 300 as follows: When the two input data A1, A0 and B1 and B0 are identical to each other, the A=B output of the comparator will produce a high level logic signal. This high level signal is connected to the base of a first transistor 342. The amplified signal in a second stage transistor 344 controls the current flow to a relay coil 346. Two other relay coils 348 and 350 are provided. As shown, in an unenergized state, relay coils 350 common contact is connected with the normally closed contact and relay coil 346 common contact is connected with normally closed contact.

The single pole double throw switch 62 located on the display 18, permits a selection between either the lane change operational mode or surveillance operational mode of the present invention. As shown in FIG. 7 when the switch 62 is positioned in a lane change mode position (i.e. as depicted by the full line position in FIG. 7), relay coil 350 becomes energized but relay coil 346 may become energized or de-energized depending upon whether the output data from the flip flops 330 and 332 are equal to the data from the optical encoder 94 at the moment of switching. If the turn signal lever (not shown) on the steering wheel of the vehicle 12 is in a neutral position at the moment of the manual positioning of the switch 62, the output of the flip flop 330 is at a low level logic while the output of the flip flop 332 is at a high level logic. Thus, if the azimuth direction of the transducer 32 is already in a central position, the two-bit data of the optical angle encoder 94 will be identical to the two-bit data of the flip flop 330 and flip flop 332. As such, under these operational conditions, the output signal from the comparator 340 will be a high level logic signal which energizes the relay coil 346 such that the motor drive 88 (utilized to pivot the transducer 32 in an azimuth directional position) will remain stationary or unactivated.

Conversely, however, if the transducer 32 is positioned at either the right or left azimuth directional position during activation of the switch 62, the normally closed contact of the relay coil 346 will cause the motor 88 to energize driving the transducer 32 towards the center azimuth directional position until the equality of the input data for the comparator 340 is established. Once equality has been established, the output of the comparator will again comprise a high level logic signal which will energize the relay coil 346 and discontinue any further activation of the electric motor 88.

With the switch 62 positioned for lane change mode operation, it will be recognized that if the driver of the vehicle positions the turn signal lever to indicate a right turn, the output of the flip flop 330 generates a high level logic signal while the output of the flip flop 332 generates a low level logic signal. Due to these logic signals generating a nonequality condition for the comparator 340, the output of the comparator assumes a low logic level which de-energizes the relay coil 346. Thus, the current is permitted to flow through the normally closed contact of the relay coil 346 to the electrical motor 88. As the motor rotates the transducer 32 rotates toward its right azimuth directional position, the optical angle encoder will subsequently generate a high level logic signal for the least significant bit and a low level logic signal for the most significant bit. At this point, the equality of the two input data for the comparator 340 is again established such that a high level logic signal to the relay coil 346 is generated. This signal thereby drives the relay coil 346 to a normally open contact whereby the current flow to the electrical motor 88 is discontinued. After the right lane change signal is discontinued by the driver, i.e. going back to a neutral position, the transducer 32 will be returned to its central position as described above.

Similarly, when the left turn signal 304 is activated by the driver, the output of the flip flop 330 assumes a high level logic signal while the output of the flip flop 332 additionally assumes a high level logic level according to the Boolean equation discussed above. Since these pair of high level logic creates a nonequality condition for the comparator 340, the output of the comparator 340 provides a low level logic whereby the relay coil 346 becomes de-energized. Thus, current flow through the normally closed contact of the relay coil 346 to the electric motor 88. As the motor rotates to position the transducer to its left azimuth direction, the angular encoder 94 will again provide high level logic signals for both the least and most significant bits and send the same to the comparator 340. Thus, as equality for the inputs of the comparator 340 is established, the output of the comparator 340 will then assume a high level logic signal which will energize the relay coil 346 causing the motor 88 to become inoperative.

With the structure defined, the overall operation of the apparatus 10 of the present invention may be described. Initially, the driver must position the housing 30 of the acoustic transmitter/receiver transducer 16 in an operative position adjacent the rear of the vehicle 12 as indicated by the full line position in FIG. 3. Subsequently, the driver may select between a surveillance operational mode or lane change operational mode as desired. For purposes of this description, it will be assumed that the surveillance operational mode is initially desired whereby the switch 62 on the display panel 18 is positioned in the phantom line position shown in FIG. 7.

In this phantom line position, it will be recognized that the relay coil 350 becomes unenergized and relay coil 348 becomes energized. Since the relay coil 346 is in series with relay coil 350, the comparator output no longer controls the flow of current to the electrical motor 88. Further, current will flow into the electric motor 88 through the normally open switch contact of relay 348. As such, in the surveillance operational mode, the electrical motor 88 is in continuous operation with the transducer 32 being continually oscillated or scanned between its left, center and right azimuth directional position.

In the preferred embodiment, the transducer azimuth scan rate in the surveillance mode is typically in the range of 15 to 60 oscillattion per minute. Of course, this rate may be adjusted by the RPM speed of the motor drive 88. In addition, the pulse repetition rate of the transmitter 32 is typically in the range of 10 pulses per second to 18 pulses per second. The identification of the azimuth direction of the transmitter 32 is accomplished by first encoding the angular azimuth position of the transducer 32 and second decoding the same to receive the two bits data in the computer control unit 18.

As the transmitter 32 transmit acoustic wave energy in the left, right and center azimuth positions, the failure to receive a signal causes the light emitting diodes 56, 58 and 60 to illuminate in a green color giving a visual display to the driver that the areas in the vicinity of the vehicle 12 are clear and unobstructed. Similarly, the numeric display 54 will indicate a blank state representing the absence of any object in the vicinity of the car 12. When an acoustic signal is received by the transducer 32 in a particular azimuth scan direction, the numeric display will indicate the range in feet during the period. In addition, one of the light emitting diode 56, 58, and 60 will change from the first color green to a second color red indicating the presence of a detected object in the vicinity of the car. When the detected object approaches within a minimum desired range, for instance ten feet, one of the light emitting diodes 56, 58, or 60 will begin to flash indicating the near presence of the detected object to the vehicle.

If desired, the switch 64 located on the display device 18 may be turned to an operative position such that during the near proximity of the detected object to the automobile, an audible tone is generated to further alert the driver to the presence of a vehicle. As will be recognized, the numeric display 54 will sequentially indicate the range of a detected object in each of the three azimuth scan directional positions and will coincide, therefore, with the illumination of the individual light emitting diodes 56, 58, and 60. As such, the numeric display provides a timesharing arrangement with each of the three separate azimuth directional positions which enables the device to monitor multiple vehicles sequentially within the scanning period.

When it is desired for the user to begin a lane change maneuver, the driver may manually switch the switch 62 into the full line position indicated in FIG. 7 causing the lane change mode control circuitry 300 to be put in operation. Depending on whether a left or right side lane change maneuver is desired, upon activation of the lane change turn signal lever (not shown) located on the steering column of the vehicle 12, the transducer receiver 32 will be moved to a corresponding azimuth directional position to continuously monitor only the left or right side vicinities of the vehicle. The corresponding light emitting diode 56 or 60 will thereby illuminate in the manner previously described in the surveillance mode, indicating the presence of nonpresence of vehicles in the adjacent highway lane. Thus, the driver of the vehicle 12 will be able to accurately observe the presence or nonpresence of a vehicle in an adjacent lane on the roadway without having to review his mirrors or turn his head.

Once completing the lane change maneuver, the return of the turn signal lever to its neutral position on the steering column will cause the transmitter receiver 32 to be automatically driven to its center position in the manner previously described and continuously monitor the presence of objects in the center direction from the vehicle. To begin the surveillance mode, the driver of the vehicle need only return the switch 62 to its phantom line position in FIG. 7 wherein constant surveillance of the right, left and center azimuth directional positions will continue.

Although in the preferred embodiment, certain circuit configurations and components have been described, those skilled in the art will recognize that various modifications to the same can be made without departing from the spirit of the present invention and such modifications are clearly anticipated herein.

What is claimed is:

1. A vehicle collision avoidance and detection apparatus comprising:

a single transmitter/receiver transducer mounted within the trunk of a vehicle for acoustically detecting an object relative said vehicle and generating a first electrical signal;

means for positioning said single transmitter/receiver transducer in multiple azimuth directional positions;

an angle encoder for generating a second electrical signal at each of said multiple azimuth directional positions;

means for processing said first and second electrical signals to determine the distance and direction of said detected object from said vehicle in said multiple azimuth directional positions;

means for displaying the determined distance and direction of said detected object in said multiple azimuth directional positions, said positioning means comprising means for sequentially positioning said single transmitter/receiver transducer in a left, center and right azimuth directional position relative said vehicle and means for selectively positioning said single transmitter/receiver transducer in a left, center and right azimuth directional position relative said vehicle;

means for switching between said sequentially positioning means and said selectively positioning means;

said displaying means comprising a numeric display adapted to visually display the determined distance of said detected object and a first, second and third light source, each adapted to illuminate in response to said single transmitter/receiver transducer being disposed in the left, center and right azimuth directional positions, respectively; and an elongate aperture formed in a portion of the trunk of a vehicle;

a cover plate sized to selectively cover and uncover said elongate aperture formed in the portion of the trunk of the vehicle; and means for positioning said single transmitter/receiver transducer within the trunk of the vehicle in registered alignment with said elongate aperture.

2. The apparatus of claim 1 further comprising servo means for driving said cover plate to positions to cover and uncover said elongate aperture.

* * * * *